US010281239B2

(12) United States Patent
Boos

(10) Patent No.: US 10,281,239 B2
(45) Date of Patent: May 7, 2019

(54) AIMING-ASSISTANCE METHOD AND DEVICE FOR LASER GUIDANCE OF A PROJECTILE

(71) Applicant: AIRBUS HELICOPTERS, Marignane (FR)

(72) Inventor: Nikolaus Boos, Marignane (FR)

(73) Assignee: AIRBUS HELICOPTERS, Marignane (FR)

( * ) Notice: Subject to any disclaimer, the term of this patent is extended or adjusted under 35 U.S.C. 154(b) by 0 days.

(21) Appl. No.: 15/498,910

(22) Filed: Apr. 27, 2017

(65) Prior Publication Data

US 2017/0314891 A1 Nov. 2, 2017

(30) Foreign Application Priority Data

Apr. 29, 2016 (FR) ..... 16 00721

(51) Int. Cl.
*F41G 7/22* (2006.01)
*F41G 7/00* (2006.01)
(Continued)

(52) U.S. Cl.
CPC ..... *F41G 7/2246* (2013.01); *F41G 3/02* (2013.01); *F41G 3/145* (2013.01); *F41G 7/007* (2013.01); *F41G 7/226* (2013.01); *F41G 7/2293* (2013.01)

(58) Field of Classification Search
CPC ..... F41G 7/2246; F41G 3/02; F41G 3/145; F41G 7/007; F41G 7/226; F41G 7/2293
(Continued)

(56) References Cited

U.S. PATENT DOCUMENTS 2,557,401 A * 6/1951 Agins ..... F41G 7/2206 114/21.3
2,969,018 A * 1/1961 Bowden ..... F41G 7/2253 244/3.16

(Continued)

FOREIGN PATENT DOCUMENTS

| | | |
|---|---|---|
| EP | 2642238 | 9/2013 |
| FR | 2719659 | 11/1995 |
| WO | 2016009440 | 1/2016 |

OTHER PUBLICATIONS

French Search Report for French Application No. FR 1600721, Completed by the French Patent Office, dated Feb. 27, 2017, 8 Pages.

*Primary Examiner* — Joshua E Freeman
(74) *Attorney, Agent, or Firm* — Brooks Kushman P.C.

(57) ABSTRACT

A method and a device for assisting aiming at a target, in particular for the purpose of improving the accuracy with which a projectile is guided towards said target by means of a laser beam. The method makes use of a camera serving to capture either a complete image of the environment, or else a selective image of said target in said environment. Thereafter, the method makes it possible to verify that said laser beam is indeed pointing at said target by displaying the point of contact of said laser beam in said environment on the image captured by said camera, and then to determine the accuracy with which said laser beam is indeed pointing at said target. As a function of said accuracy, launching of said projectile may either be confirmed or cancelled. This method also makes it possible to identify the code of said guide beam illuminating said target.

20 Claims, 2 Drawing Sheets

(51) Int. Cl.
*F41G 3/02* (2006.01)
*F41G 3/14* (2006.01)

(58) Field of Classification Search
USPC ..... 244/3.13; 348/169
See application file for complete search history.

(56) References Cited

U.S. PATENT DOCUMENTS 3,239,674 A * 3/1966 Aroyan ..... G01S 3/787 244/3.16
3,306,206 A * 2/1967 Grantham ..... F42C 17/04 102/206
3,366,346 A * 1/1968 McKnight ..... F41G 7/303 244/3.11
3,617,016 A * 11/1971 Bolsey ..... F41G 7/22 244/3.16
3,859,460 A * 1/1975 Westell ..... G01S 3/786 348/169
4,143,835 A 3/1979 Jennings, Jr. et al.
4,407,465 A * 10/1983 Meyerhoff ..... F41G 7/2293 244/3.16
4,558,836 A * 12/1985 Kriegesmann ..... F41G 7/2286 244/3.11
4,615,590 A * 10/1986 Alvarez ..... G02B 27/64 359/556
4,678,142 A * 7/1987 Hirschfeld ..... F41G 7/226 244/3.16
4,911,541 A * 3/1990 Alvarez ..... G02B 7/02 359/557
4,913,547 A * 4/1990 Moran ..... G01B 9/02067 356/489
5,122,908 A * 6/1992 Sporer ..... G02B 27/644 359/554
5,194,908 A * 3/1993 Lougheed ..... G01P 3/38 250/332
5,375,008 A * 12/1994 Guerreri ..... G01S 17/74 342/45
5,601,255 A 2/1997 Romer et al.
5,664,741 A * 9/1997 Duke ..... F41G 7/26 244/3.11
5,841,059 A * 11/1998 Laurend ..... F42C 13/006 102/213
6,003,810 A * 12/1999 Roze des Ordons ..... F41G 7/2293 244/3.13
6,023,058 A * 2/2000 Merle ..... F41G 7/226 244/3.16
6,023,322 A 2/2000 Bamberger
6,069,656 A 5/2000 Silver
6,487,953 B1 * 12/2002 McIngvale ..... F41G 7/305 244/3.16
6,491,253 B1 * 12/2002 McIngvale ..... F41G 3/02 244/3.11
6,662,701 B2 * 12/2003 Grosch ..... F41B 7/00 89/1.13
6,671,538 B1 * 12/2003 Ehnholm ..... A61B 90/10 382/131
6,851,645 B1 * 2/2005 Williams ..... F41G 7/2293 244/3.15
6,891,984 B2 * 5/2005 Petersen ..... A61B 5/0066 385/117
7,053,993 B2 * 5/2006 de Virel ..... F41G 7/226 244/3.16
7,059,560 B2 * 6/2006 Ljungberg ..... F41G 7/008 244/3.1
7,575,191 B2 * 8/2009 Layton ..... F41G 7/226 244/3.1
7,745,767 B2 * 6/2010 Bredy ..... F42C 13/026 244/3.1
7,767,945 B2 * 8/2010 Williams ..... F41G 3/145 244/3.1
7,907,174 B2 * 3/2011 Stuckler ..... H04N 5/23248 348/208.4
7,932,924 B2 * 4/2011 Higo ..... G03B 5/00 348/208.11
7,964,831 B2 * 6/2011 Hurty ..... F41G 3/145 244/3.11
8,344,302 B1 * 1/2013 Murphy ..... F41G 7/007 244/3.1
8,675,186 B2 * 3/2014 Guthrie ..... G01C 3/08 356/139.06
8,797,511 B2 * 8/2014 Tiefenthaler ..... G01C 3/08 356/3.01
8,908,030 B2 * 12/2014 Perruchot ..... F41G 3/02 348/135
8,970,708 B2 * 3/2015 Goldblatt ..... H04N 17/002 348/139
8,988,659 B2 * 3/2015 Berthault ..... G01S 17/023 356/4.01
9,360,680 B1 * 6/2016 Syrgabaev ..... G02B 27/648
10,024,967 B2 * 7/2018 Liang ..... G01S 17/89
10,027,891 B2 * 7/2018 Masuda ..... G01C 3/06
10,027,892 B2 * 7/2018 Masuda ..... G01C 3/06
10,051,185 B2 * 8/2018 Masuda ..... G01C 3/06
10,051,186 B2 * 8/2018 Masuda ..... G01C 3/06
10,057,494 B2 * 8/2018 Masuda ..... G01S 7/497
2009/0078817 A1 3/2009 Williams
2013/0087684 A1 4/2013 Guetta et al.

* cited by examiner

AIMING-ASSISTANCE METHOD AND DEVICE FOR LASER GUIDANCE OF A PROJECTILE

CROSS-REFERENCE TO RELATED APPLICATIONS

This application claims priority to French patent application No. FR 16 00721 filed on Apr. 29, 2016, the disclosure of which is incorporated in its entirety by reference herein.

BACKGROUND OF THE INVENTION (1) Field of the Invention

The present invention relates to the field of guiding projectiles. The invention relates more particularly to guiding projectiles with the assistance of a laser beam.

The present invention relates both to a method and also to a device for assisting aiming at a target. The present invention also relates both to a method of guiding a projectile by means of a laser beam and using such a method of assisting aiming, and also to a device for guiding a projectile by means of a laser beam and fitted with such a device for assisting aiming.

(2) Description of Related Art

Laser beam guidance is used in particular by the military for guiding a missile or any other projectile to a target illuminated by means of a laser beam. This technique is known as "semi-active laser homing" or by the initials SALH. In this technique, and as described in document U.S. Pat. No. 4,143,835, a laser beam is kept pointed on a target by an operator, often referred to by the term "shooter". Reflections of the laser beam are then dispersed in a multitude of directions by reflection on the target. A projectile, such as a missile, can then be launched or released towards the target.

When the projectile is close enough to the target, a receiver device included in the projectile receives a portion of the laser beam reflected by the target, and then determines the source of this reflected portion of the laser beam, i.e. the target. The trajectory of the projectile is then adjusted towards the source. The projectile, which properly speaking does not possess any autonomous means for detecting the target, is then guided solely towards the source by the portion of the reflected laser beam that it receives.

Thus, so long as the laser beam is kept pointed on the target and so long as the guidance device of the projectile receives a portion of the reflected laser beam, the trajectory of the projectile can be corrected so as to guide the projectile exactly onto the target. Emission of the laser beam is thus dissociated from the projectile and may be performed by an operator, for example. In contrast, the operator needs to have the target in view in order to be able to point the laser beam at it. Advantageously, the zone from which the projectile is launched is totally independent of the zone from which the laser beam is emitted. The laser beam is emitted by a laser-beam generator such as a laser designator.

In order to guide the projectile accurately towards the target, it is essential for the laser beam illuminating the target to be of good quality, which depends essentially on the percentage of the laser beam that actually reaches the target. A laser beam used for guiding a projectile is generally constituted by a succession of pulses emitted at time intervals that may be regular or irregular, but by that in any event are known in order to be identifiable by the receiver means of the projectile.

Consequently, all of the laser beam pulses that are not pointed at the target will guide the projectile away from the target, whereas all of the laser beam pulses that are pointed at the target will guide the projectile exactly to the target.

A laser beam used for guiding a projectile could equally well be a continuous laser beam.

The aiming procedure always begins by scanning the environment that is visible to the operator looking for targets, and continues by ceasing to scan in order to focus on a target. Under such circumstances, the operator needs to point the laser beam permanently at the target in order to guide the projectile.

Nevertheless, it can be difficult to point accurately at a target permanently, in particular when the target is moving relative to the operator. Specifically, the target may be a moving vehicle, e.g. a land vehicle or an aircraft. The operator may also be moving, e.g. being on board a land vehicle or an aircraft.

Furthermore, the operator does not have direct visual feedback about the point in the environment that is actually illuminated by the laser beam. Specifically, the reflection of the laser on the target is generally not visible to the operator. The operator thus can only rely on the aim, e.g. performed using crosshairs of telescopic sights for a portable laser designator, or else by using display means incorporated in a helmet for a laser designator on board a vehicle. Consequently, there may be an offset between the crosshairs and the laser beam proper, giving rise to an aiming error that is not perceived by the operator. Only the impact of the projectile informs the operator about the accuracy of the initial aim and the aiming error, if any. Specifically, when the projectile has missed the target, the operator might possibly correct the aim as a function of the point of impact of the projectile relative to the target, but only after a first miss.

Furthermore, it should be recalled that a laser beam is a particular kind of light beam made up of light that is coherent and concentrated. The term "laser" is an acronym for "light amplification by stimulated emission of radiation". Also, the term "light beam" is generally used to designate a beam made up of light that is visible to the human eye. Nevertheless, and by extension, it is also possible to use the term "light beam" to designate a light beam made up of electromagnetic waves that are not visible, e.g. situated in the infrared or the ultraviolet ranges. A laser beam may thus equally well be a light beam that is situated in the range visible to the human eye or in a range that is not visible.

Furthermore, a device for correcting projectile trajectories is described in document FR 2 719 659. That corrector device emits a guide beam for guiding projectiles that is directed towards a target. The guide beam is subdivided into at least five partial beams, a central partial beam that is indeed directed on the target, and at least four partial beams that are inclined relative to the central partial beam. The projectiles illuminated by an inclined partial beam are therefore not directed towards the target and they have their trajectories corrected accordingly.

Furthermore, documents US 2009/078817 and EP 2 642 238 are known, which describe a system for guiding a missile or any other projectile onto a target illuminated by means of a laser beam.

In particular, document US 2009/078817 describes a projectile guidance system seeking to reduce the number of pulses of the guide beam in order to reduce the total energy sent towards the target. That device requires communication between the projectile and the guide-beam generator in order to synchronize reception of the reflected guide beam and emission of the guide beam.

Also known is document U.S. Pat. No. 6,069,656, which describes a method and a device for stabilizing images for use in a system for providing a projectile with laser guidance. In particular, that method makes it possible to display the total scene picked up by a camera, or else only a portion of the scene corresponding to a zoom mode. Furthermore, that method makes it possible to display a single point of contact of the guide beam, with the distance between crosshairs situated on the target and the point of contact being used in order to correct the guide beam.

Finally, the following documents US 2013/087684, WO 2016/009440, and U.S. Pat. No. 6,023,322 are known, which describe a system and/or a method for analyzing quality criteria of a guide beam in a system for laser designation of a target.

According to document US 2013/087684, image capture means enable the guide beam to be analyzed by means of points of contact of the guide beam on the target.

According to document WO 2016/009440, radiation capture means serve to analyze the guide beam as reflected by the target, and in particular the arrival time of the guide beam as reflected by the target onto the sensor, its angle of arrival, and/or its arrival position on the sensor.

Document U.S. Pat. No. 6,023,322 serves to determine the ratio between the number of contact points of the guide beam as reflected by the target and the number of pulses of the emitted guide beam, e.g. making it possible to find the best zone of the target on which to aim the guide beam.

BRIEF SUMMARY OF THE INVENTION

In this context, an object of the present invention is to enable a guide beam to be aimed reliably and accurately on a target. The present invention enables the operator to be supplied with information feedback about the zone that is actually aimed at, by using an image of the environment and of the target. The present invention makes use in particular of a new type of camera capable of creating a selective image of the target in the environment.

An object of the present invention is thus to provide both a method and also a device for assisting aiming at a target that make it possible to overcome the above-mentioned limitations in order to improve the quality and the accuracy of the aim on the target by means of a guide beam. The present invention also relates both to a method of guiding a projectile by means of a guide beam using such a method of assisting aiming, and also to a device for guiding a projectile by means of a guide beam and fitted with such device for assisting aiming.

According to the invention, a method of providing assistance in aiming at a target comprises the following steps:

a first step of completely scanning an environment with a camera;

a second step of displaying a complete image of the environment;

a third step of identifying and selecting a target in the complete image of the environment;

a fourth step of an operator pointing at the target with a guide beam;

a fifth step of displaying a complete image of the environment and of the point of contact of the guide beam in the environment;

a sixth step of the operator pointing at the target with a guide beam;

a seventh step of selectively scanning the target and the point of contact of the guide beam in the environment with the camera; and an eighth step of displaying a selective image of the target and of at least one point of contact of the guide beam in the environment.

This method of the invention is particularly intended for methods of guiding a projectile towards a target by means of a guide beam. The guide beam is emitted by a guide-beam generator. The guide beam may be a light beam that is optionally visible by the human eye, depending on the wavelengths making up the light beam. The guide beam is preferably a laser beam. By way of example, the laser beam is emitted by a laser-beam generator known type such as a laser designator dedicated to aiming at a target.

Also, the guide beam may be a beam that is either continuous or else that is made up of a succession of pulses over regular intervals. Under such circumstances, the guide beam is defined in particular by time characteristics constituted by the frequency and the duration of the pulses.

The guide-beam generator may be portable and used directly by an operator. The guide-beam generator may equally well be mounted on board a vehicle.

Furthermore, the guide-beam generator may be associated with the projectile launcher device, the guide-beam generator and the projectile launcher device being carried by the same vehicle, for example. This may be referred to as "autonomous designation".

The guide-beam generator may also be carried by a third party, e.g. by a shooter on the ground, in which case it is separate from the projectile launcher device, which may be carried by a vehicle. This may be referred to as "remote designation".

The method also makes use of a camera in order to capture the environment and the target in association with display means, in particular for displaying the images captured by the camera. The display means may be incorporated in telescopic sights of a portable guide-beam generator, or in a helmet for a guide-beam generator on board a vehicle. The display means may equally well be a screen that is separate from the guide-beam generator.

Likewise, the camera may be associated with the guide-beam generator or it may be separate from the guide-beam generator. For example, the guide-beam generator may be carried by an operator on the ground, while the camera is carried by a vehicle, the vehicle possibly also carrying the projectile launcher device.

The camera used by the method of the invention is preferably a camera of a new type known as a "bio-inspired camera" or an "event-based camera". Such cameras have a very wide radiometric dynamic range, i.e. by the ability to see both pale and dark items at the same time, and by very fine resolution in time, of microsecond order. By their very principle, such cameras thus make it possible for each pixel to measure a radiometric change with high accuracy in time. A change in the scene, e.g. due to the presence of a pulse of a guide beam or of an item that is moving, is thus detected naturally. The term "radiometric change" of an item is used to designate a change observed in the magnitude of the energy of the radiation emitted by that item, or in derived properties such as the flux or the intensity of such radiation.

Particular items for which respective radiometric changes are detected can thus be isolated in the environment. As a result, such a camera does not necessarily capture a complete image of the environment as does a traditional camera, but rather captures an image of the environment that includes only one or more particular items for which radiometric changes have been detected, and in particular one or more selected targets.

An aiming procedure always begins by scanning the visible environment looking for targets, and then continues by ceasing to scan in order to focus on a target.

The first step of the method of the invention thus consists in performing a complete scan of the environment with the camera. A complete image of the environment is thus captured. During the second step, the complete image of the environment is then displayed on the display means so that, during the third step, a target can be identified and selected in this complete image of the environment.

Such identification and selection are performed by an operator, who may for example be the operator in charge of aiming at the target with the guide beam. The operator identifies a target in the complete image of the environment, and then selects it.

This selection may be performed by the operator who aims at the target by using the guide-beam generator, but without emitting the guide beam. The operator then uses the telescopic sights of the guide-beam generator and, while aiming at the target, the operator actuates selector means such as a pushbutton or a switch in order to select the aimed-at target. The operator generally makes use of the crosshairs present in the telescopic sights of the guide-beam generator in order to aim at the target.

This selection may also be performed directly on the display means by moving the crosshairs onto the target, and then actuating the selector means. The crosshairs may be moved by using a mouse or by acting directly on the display means, which are then constituted by a touchscreen, with the target selector means then likewise being the mouse or the touchscreen.

The target may also be identified by its coordinates, e.g. using a satellite locating system, with the operator then selecting the target by using the selector means to confirm that the coordinates do indeed correspond to the target.

Under all circumstances, the target may be selected automatically when the operator is aiming at a target that is stationary or indeed when the crosshairs are held stationary for a first predetermined duration. By way of example, this first predetermined duration may be three seconds (3 s).

Such automatic selection is also possible for a moving target, in particular by making use of an image processor system, e.g. of the kind known as a "moving target indicator" that serves to align the crosshairs on the identified moving target.

Thereafter, during the fourth step, the operator points the guide beam at the target in order to guide the projectile to the target. As a general rule, the operator makes use of the crosshairs present in the telescopic sights of the guide-beam generator for aiming at the target, or else acts directly on the display means by positioning the crosshairs on the target. Furthermore, the operator needs to keep the guide beam pointing permanently at the target by using the guide-beam generator until the projectile strikes the target. Specifically, if the operator points the guide beam at some other item away from the target, then the projectile will go towards that other item. Likewise, if the operator stops the guide-beam generator and no guide beam is emitted, then the projectile will not know where to go.

Furthermore, in order to update the complete display of the environment, the first step and the second step are preferably repeated so long as the operator has not pointed the guide beam at the target.

Also, the operator generally does not see the point of contact of the guide beam on the target, which guide beam may be visible or not visible to the human eye. Specifically, the operator cannot verify whether the beam is actually illuminating the intended target.

Nevertheless, the guide beam and its reflection on the target are advantageously still visible to the camera. Consequently, the points of contact of the guide beam in the environment, and in particular on the target, continue to be visible and capturable by the camera.

It should be observed that other devices now becoming available make it possible to capture the points of contact of the guide beam in the environment. For example, there exists a sensor known as a "see spot". Nevertheless, such devices have a low capture frequency and are therefore not suitable for capturing the points of contact of the guide beam in the environment if they are too close together in time and providing they occur in the time window in which such devices capture an image.

The method of the invention then advantageously includes a fifth step during which the complete image of the environment is displayed on the display means together with the point of contact of the guide beam in the environment.

The operator can then view the point of contact of the guide beam in the image of the environment and can verify that the point of contact is indeed situated on the target. As a result, if the point of contact is not situated on the target, the operator can then correct the aim. Specifically, an offset between the crosshairs and the guide beam proper may exist as a result of inaccuracies in the system and may give rise to an offset between the aiming direction and the direction of the guide beam, and consequently to an aiming error.

Thereafter, during the sixth step, the operator points the guide beam once more at the target. During this sixth step, the operator may optionally correct the aim as a function of the position of the point of contact of the guide beam on the environment relative to the target in the image displayed during the preceding step.

With the target identified, the camera used by the method advantageously acts, during the seventh step, to perform a selective scan of the target and of the point of contact of the guide beam in the environment. Specifically, as mentioned above, the camera used by the method of the invention makes it possible to capture no more than a portion of the environment in which a radiometric change has been detected. Thus, the camera can capture specifically the target as selected during the third step and struck by the guide beam, and can also capture the point of contact of the guide beam. Other items in the environment may also be captured depending on any radiometric changes associated therewith. Nevertheless, the number of items captured during the seventh step and subsequently displayed during the eighth step is considerably reduced compared with capturing and displaying a complete image of the environment as take place respectively in the first and second steps.

Finally, during the eighth step, a selective image of the target and of at least one point of contact of the guide beam in the environment is displayed. Once more, the operator can view the point of contact of the guide beam in the selective image of the environment and can verify that the point of contact is still indeed situated on the target. Advantageously, this selective image is simplified and displays mainly the target, the point of contact of the guide beam on the environment, and possibly other items for which there have been radiometric changes. This selective display advantageously leads to faster analysis on the part of the operator who immediately sees the position of the point of contact of the guide beam on the environment relative to the target.

The sixth, seventh, and eighth steps are then repeated until the projectile strikes, the steps being performed continuously.

Thus, during the pointing sixth step, the operator initially makes use of the complete image displayed during the fifth step in order to correct the aim on the target, where necessary, and thereafter makes use of the selective images displayed in succession during the eighth step.

The method of the invention for assisting aiming advantageously enables the operator while taking aim to be provided with information and feedback about the positions of the target and of the points of contact of the guide beam on the environment, initially by displaying the complete image and then by displaying selective images of the environment. This display of the selective image does make it possible to improve aiming accuracy, since the operator can act immediately in real time and continuously to correct any offset between the position of the point of contact of the guide beam on the environment and the target.

Furthermore, the crosshairs can be displayed on the target in order to facilitate identifying the target in the displayed image, whether it is a complete image of the environment or else a selective image of the target and of at least one point of contact of the guide beam in the environment. The crosshairs can thus be displayed during the second, fifth, and eighth steps of displaying an image in the aiming assistance method of the invention.

Also, the aiming assistance method of the invention may include additional steps after the eighth step for the purpose of quantifying the accuracy of the aim on the target. Specifically, since the image displayed during the second, fifth, and eighth steps includes in particular the target and the point of contact of the guide beam in the environment, it is possible to analyze each successively-displayed image in order to determine a first number of points of contact of the guide beam touching the target and a second number of points of contact of the guide beam not touching the target, once the target has been selected in the third step.

The aiming assistance method of the invention may thus include a ninth step of calculating the first number of points of contact of the guide beam touching the target, and the second number of points of contact of the guide beam not touching the target since selection of the target during the third step. Furthermore, the percentage of the points of contact of the guide beam that actually touch the target from among all of the points of contact of the guide been in the environment may optionally be calculated during this ninth step.

Thereafter, during a tenth step of displaying information, information about the accuracy of the points of contact of the guide beam touching the target is displayed on the display means.

This information about the accuracy of the points of contact of the guide beam touching the target may be formed by the first number and by the second number, or else by a percentage of the points of contact of the guide beam actually touching the target from among all of the points of contact of the guide beam in the environment.

Also, during the eighth step, the points of contact of the guide beam in the environment may be captured during a second predetermined duration, and then displayed together with the selective image of the target. The operator can thus view the successive positions of the points of contact over the second predetermined duration and thus observe any loss of accuracy in the aim, or indeed any improvement in the aim.

Under such circumstances, during this eighth step, the selective image of the target and of the current point of contact of the guide beam in the environment may be displayed simultaneously with at least one of the previously-displayed points of contact.

The term "current" point of contact of the guide beam is used to mean the point of contact of the guide beam as picked up by the camera during the seventh step of selective scanning that takes place immediately before the eighth step. The term "previously-displayed" point of contact is used to mean the point of contact displayed during the fifth step of displaying a complete image of the environment and of the point of contact of the guide beam in the environment, and also any point of contact displayed during any preceding eighth steps of displaying images. By way of example, the previously-displayed points of contact are constituted in part by the points of contact captured during the second predetermined duration.

Likewise, the ninth step may also take place over the second predetermined duration. As a result, the accuracy information displayed during the tenth step is determined over this second determined duration.

Furthermore, the aiming assistance method of the invention may include another additional step that takes place after the fourth step, i.e. after pointing the guide beam on the target, and in parallel with the following steps, namely the fifth to the eighth steps. This additional step makes it possible to identify the guide beam aiming at the target. Specifically, the points of contact of the guide beam in the environment continue to be visible and capturable by the camera. Specifically, by analyzing these points of contact it is possible to determine firstly whether the guide beam is continuous or else made up of a succession of pulses, and secondly to determine the time characteristics of the guide beam. Thereafter, the time characteristics of the guide beam used for aiming at the target are known and constitute the code of the guide beam. Advantageously, it is then possible to verify that the time characteristics of the guide beam visible on the target do indeed correspond to the expected guide beam code, thereby determining that the guide beam seen by the camera on the target is indeed the expected guide beam.

The aiming assistance method of the invention may thus include an eleventh step of analyzing and identifying the guide beam, with the points of contact of the guide beam in the environment being analyzed in order to determine the time characteristics of the guide beam and thus to identify the code of the guide beam visible on the target.

For a guide beam made up of a succession of pulses, the time characteristics of the guide beam are the frequency and the duration of the pulses. In contrast, a continuous guide beam does not have pulses and no frequency can be determined. The time characteristics of such a continuous beam are the absence of pulses and frequency.

It should be observed that existing devices enabling the points of contact of the guide beam in the environment to be captured, such as a "see spot" device, are not capable of analyzing these contact points in order to determine the time characteristics of the guide beam.

The points of contact of the guide beam in the environment can be captured as from the guide beam being pointed at the target during the fourth step, or else during a third predetermined duration. This third predetermined duration may be equal to the second predetermined duration.

Such captures of the points of contact of the guide beam in the environment can be useful in particular for subsequent analysis of firing the projectile, e.g. in the event of a target error, and in particular in the event of "friendly" fire.

Finally, between the fourth step of pointing at the target and the fifth step of displaying an image, the method of the invention for assisting aiming at a target may include an intermediate step of using the camera to scan the environment completely. This intermediate step thus consists in a new complete scan of the environment for the purpose of updating the display of the target and of the environment prior to displaying this complete environment during the fifth step. This intermediate step makes it possible in particular to take account of any movement of items in the environment, and in particular of the target.

The method of the invention for assisting aiming at a target advantageously makes it possible during the fifth and the eighth steps to visualize the three-dimensional behavior of the guide beam in the environment and thus to verify the effectiveness of the aiming.

Furthermore, during the ninth and tenth steps, this method makes it possible to quantify this three-dimensional behavior of the guide beam by providing accuracy information.

Also, during the eleventh step, this method makes it possible to quantify the time behavior of the guide beam and to identify the code of the guide beam in order to make sure that the guide beam is indeed the expected guide beam.

The present invention also provides a method of guiding a projectile by means of a guide beam, the method comprising:

a step of illuminating a target by a guide beam;

a step of locking the projectile on the target;

a step of launching a projectile; and a step of guiding the projectile towards the target.

The guide beam is preferably a laser beam. The above-described method of assisting aiming is then applied to the illumination step in order to improve the accuracy with which the target is illuminated, and consequently improve the accuracy with which a projectile is launched against the target.

The step of the projectile locking on the target can then be performed as a function of the information about the accuracy of the points of contact of the guide beam touching the target and/or of the time characteristics of the guide beam striking the target. The locking step may be performed manually by the operator.

This may equally well be done automatically, if the information about the accuracy of the points of contact of the guide beam touching the target is greater than or equal to a predetermined threshold and/or if the time characteristics of the guide beam striking the target correspond to the expected code for the guide beam.

Also, the step of launching the projectile may be cancelled as a function of this information about the accuracy of the points of contact of the guide beam touching the target. Such cancellation may be performed manually by the operator. It is also possible for such cancellation to be performed if the operator observes an unexpected event on the display of the selective image during the eighth step, where such an unexpected event may be a vehicle approaching the target, which vehicle is not to be struck by the projectile.

This cancellation may equally well be done automatically, if the information about the accuracy of the points of contact of the guide beam touching the target is less than the predetermined threshold and/or if the time characteristics of the guide beam striking the target do not correspond to the expected code for the guide beam.

Thus, if the accuracy of the points of contact relative to the selected target is sufficient, the projectile is locked on and/or fired. Otherwise, the probability of the projectile reaching the target is too small and the projectile is not locked on and/or fired.

Furthermore, the step of launching the projectile may be performed prior to the step of locking the projectile on the target.

The present invention also provides a device for assisting aiming at a target, the device comprising a camera, display means, a computer, and selector means.

The camera is suitable for capturing specific information about particular items in the captured environment, the target being a particular item in the environment. The particular items are isolated by the camera depending on respective radiometric changes, e.g. as a result of the particular items moving.

Furthermore, the computer of the device for assisting aiming at a target may be configured in particular in order to analyze each image displayed in succession on the display means and to determine a first number of points of contact of the guide beam touching the target, and a second number of points of contact of the guide beam not touching the target. The computer also serves to determine the percentage of these points of contact actually touching the target relative to the total number of points of contact of the guide beam in the environment.

The computer may optionally be configured to analyze the environment seen by the camera, and in particular the point of contact of the guide beam in the environment, in order to determine the time characteristics of the guide beam, and consequently in order to identify the code of the guide beam.

The device for assisting aiming at a target may thus perform the above-described method of assisting aiming at a target in order to improve the accuracy of the aiming at the target.

Finally, the present invention also provides a system for guiding a projectile by means of a guide beam, the system comprising a guide-beam generator, an above-described device for assisting aiming, and a projectile provided with a receiver device.

The device for assisting aiming is configured so as to improve the accuracy with which the target is illuminated so that the accuracy with which the projectile is fired at the target is improved. The guide-beam generator is preferably a laser-beam generator.

This system for guiding a projectile by means of a guide beam can thus perform the above-described method of guiding a projectile by a guide beam.

BRIEF DESCRIPTION OF THE DRAWINGS

The invention and its advantages appear in greater detail in the context of the following description of embodiments given by way of illustration and with reference to the accompanying figures, in which.

Elements that are present in more than one of the figures are given the same references in each of them.

DETAILED DESCRIPTION OF THE INVENTION

Figure 1:
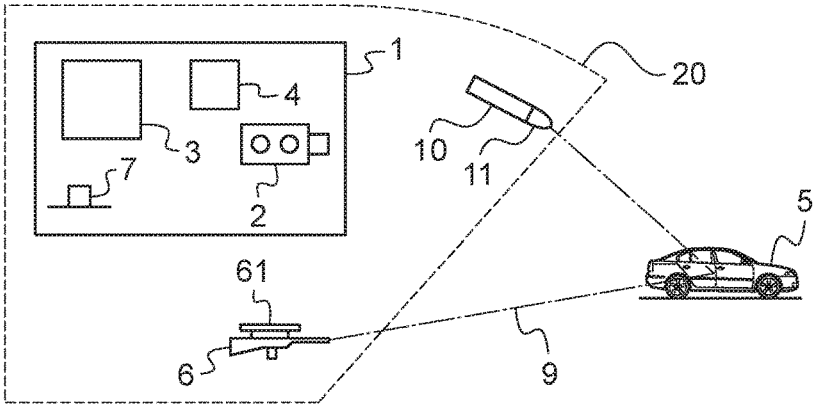
FIG. 1 shows a system of the invention for guiding a projectile by a guide beam.

FIG. 1 shows a guide system 20 for guiding a projectile by a guide beam, the system 20 including a generator 6 for generating a guide beam 9, a projectile 10 having a receiver device 11, and an aiming-assistance device 1. This system 20 for guiding a projectile 10 by means of a guide beam serves to guide the projectile 10, e.g. a missile, towards a target 5. The generator 6 for generating a guide beam 9 may be used by an operator to aim at a target 5 with the guide beam 9, the operator being situated on the ground and stationary. The generator 6 for generating a guide beam 9 then generally includes telescopic sights 61 for aiming at the target 5. The generator 6 for generating a guide beam 9 may also be on board a vehicle, such as an aircraft, and it may be used equally well while the vehicle is moving or while the vehicle is stationary. By way of example, the guide beam 9 is a laser beam constituted by successive pulses.

The target 5 is initially illuminated by the guide beam 9 emitted by the generator 6, and reflections of this guide beam 9 are then dispersed in a multitude of directions by reflection on the target 5. The guide beam 9 may be visible or invisible to the human eye, depending on the wavelengths making up the guide beam 9.

In parallel with this illumination of the target 5, or indeed subsequently, the projectile 10 is launched towards the target 5. The projectile 10 includes a receiver device 11 that, on approaching target 5, receives a portion of the guide beam 9 as reflected by the target 5, and then determines the source of this portion of the reflected guide beam 9. Finally, the projectile 10 is guided and directed towards the source, i.e. the target 5, so long as the guide beam 9 is pointed on the target 5 and illuminates it.

The device 1 for assisting aiming at a target 5 comprises a camera 2, display means 3, a computer 4, and selector means 7. The display means 3 constitute a screen. The device 1 for assisting aiming at a target 5 is configured to improve the accuracy of the aim on the target 5 by performing a method of providing assistance in aiming at a target as summarized by the diagram shown in FIG. 2 and comprising the following steps.

During a scanning, first step 101, an environment is scanned completely by using the camera 2.

Figure 3:
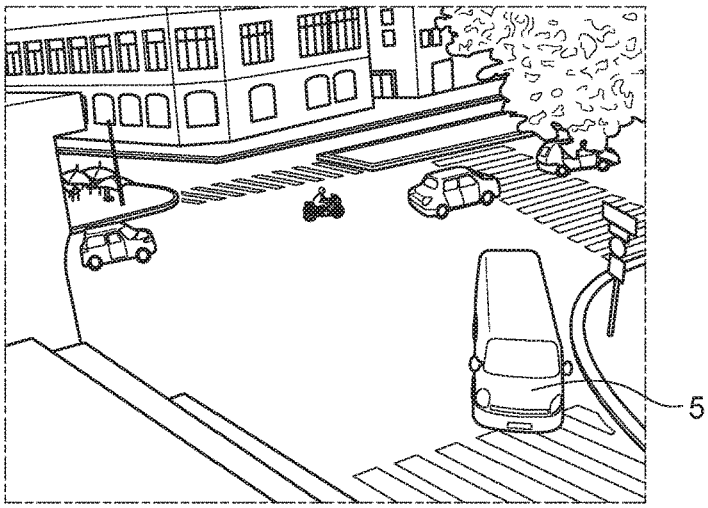
FIGS. 3 and 4 show complete images of the environment displayed on the display means.

During a display, second step 102, a complete image of this environment corresponding to the complete scan of the environment is displayed on the display means 3. This complete image is shown in FIG. 3.

During a third step 103 of identifying and selecting a target, a target 5 is identified and then selected in the complete image of the environment. This identification is performed by an operator in charge of aiming at the target with the guide beam 9.

Thereafter, the operator selects the target 5 in the complete image of the environment. This selection is performed by selector means 7, such as a pushbutton, while the operator is aiming at the target 5. This selection is performed by the operator while aiming at the target 5 by using the guide-beam generator 6, but without emitting the guide beam. By way of example, the operator then makes use of the telescopic sights 61 of the guide-beam generator 6 in order to aim at the target 5, and then actuates the selector means 7 in order to select the target 5 being aimed at.

This selection of the target 5 may also be done automatically when the operator aims at a target 5 that is stationary or aims at the target for a first predetermined duration.

During a fourth step 104, the operator points the guide beam 9 on the target 5 in order to guide the projectile 10 to the target 5. The operator generally makes use of the crosshairs present in the telescopic sights 61 of the guide-beam generator 6 in order to aim at the target 5.

The first step 101 and the second step 102 are repeated prior to performing the fourth step 104 in order to update the complete display of the environment.

Figure 4:
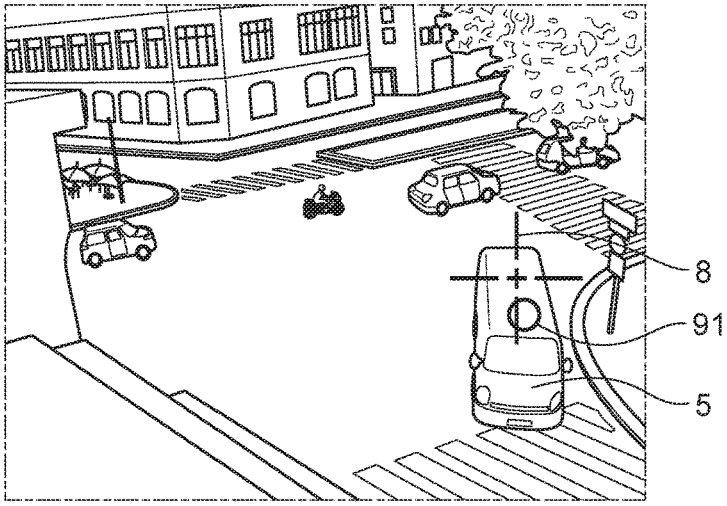

During a display, fifth step 105, the complete image of the environment is displayed on the display means 3 together with the point of contact 91 of the guide beam 9 in the environment. Specifically, the guide beam 9 and its reflection on the target 5 are advantageously still visible to the camera 2. Also, crosshairs 8 may also be displayed on the display means 3, thus informing the operator about the point of the environment that is being aimed at. This complete image including the point of contact 91 of the guide beam 9 and the crosshairs 8 is shown in FIG. 4.

This display, fifth step 105 thus enables the operator to view and verify firstly that the crosshairs 8 are indeed pointed at the target 5 and secondly that the point of contact 91 of the guide beam 9 also points at the target 5. Specifically, the operator must point the guide beam 9 permanently at the target 5 until the projectile 10 strikes the target 5.

Also, an intermediate step 115 of completely scanning the environment may be performed between the fourth step 104 of pointing at the target 5 and the display, fifth step 105. As a result, by making a complete new scan of the environment with the camera 2, a new complete image of the environment together with the point of contact 91 of the guide beam 9 can be displayed during the fifth step 105, in order to update this display of the target 5 and of the environment.

Thereafter, during a pointing, sixth step 106, the operator points again at the target 5 with the guide beam 9. This pointing, sixth step 106 advantageously enables the operator to correct the aim if the point of contact 91 is not situated on the target 5 in the complete image displayed during the display, fifth step 105.

During a scanning, seventh step 107, the camera 2 performs a selective scan of the target 5 and of the point of contact 91 of the guide beam 9 in the environment. The camera 2 is a camera capable specifically of capturing information about particular items in the environment as a result of radiometric changes concerning them, e.g. because they are moving. For example, the camera 2 is capable of capturing specifically information about only those particular items in the environment that are moving, together with the points of contact 91 of the guide beam 9.

Figure 5:
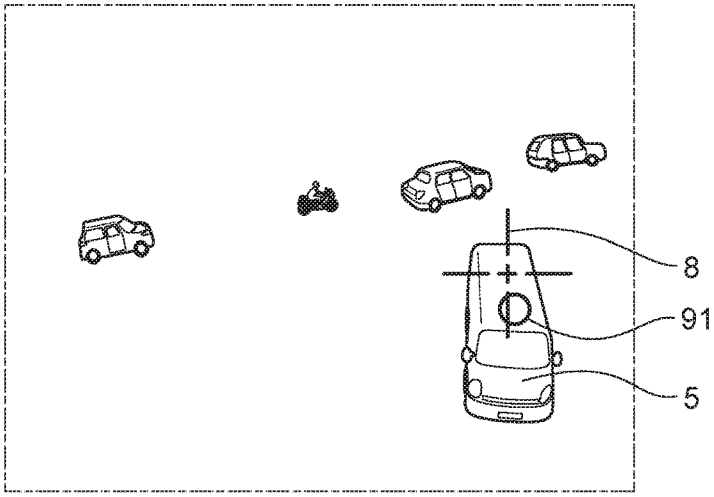
FIGS. 5 to 7 show selective images of the environment displayed on the display means.

Finally, during a display, eighth step 108, this selective image of the target 5 is displayed together at least with the point of contact 91 of the guide beam 9 in the environment. Once more, the operator can view the point of contact 91 of the guide beam 9 in the selective image of the environment and can verify that the point of contact 91 is still indeed situated on the target 5. Advantageously, this selective image is simplified and displays mainly the target 5, which may be moving for example, together with the point of contact 91 of the guide beam 9 in the environment. Advantageously, this selective image speeds up analysis by the operator, who sees immediately the position of the point of contact 91 relative to the target 5. As in the display, fifth step 105, the crosshairs 8 may be displayed on the display means 3 in order to inform the operator about the point of the environment that is being aimed at. This selective image including the point of contact 91 of the guide beam 9 and the crosshairs 8 is shown in FIG. 5.

The sixth, seventh, and eighth steps are then repeated until the projectile 10 strikes, the steps being performed continuously.

Once the target 5 has been identified and selected, the aiming-assistance device 1 thus uses the images it displays on the display means 3 advantageously to provide the operator with feedback about the positions of the target 5 and of the point of contact 91 of the guide beam 9 in the environment, and it does so in real time and while the operator is performing the aiming operation. The operator can then immediately correct any difference between the position of the point of contact 91 relative to the target 5 and thus improve the accuracy of the aim.

Furthermore, the aiming-assistance device 1 also serves to quantify the accuracy of the aim. Specifically, the computer 4 is configured to analyze each image that is displayed in succession on the display means 3 and to act during a ninth step 109 to determine a first number of points of contact 91 of the guide beam 9 that touch the target 5, and a second number of points of contact 91 of the guide beam that do not touch the target 5. The computer 4 also serves to calculate the percentage of these points of contact 91 actually touching the target 5 relative to the total number of points of contact 91 of the guide beam 9 in the environment. Thereafter, during a tenth step 110, information 92 about the accuracy of the points of contact 91 touching the target 5 can be displayed on the display means 3 in the form of this percentage of the points of contact 91 that are actually touching the selected target.

Figure 2:
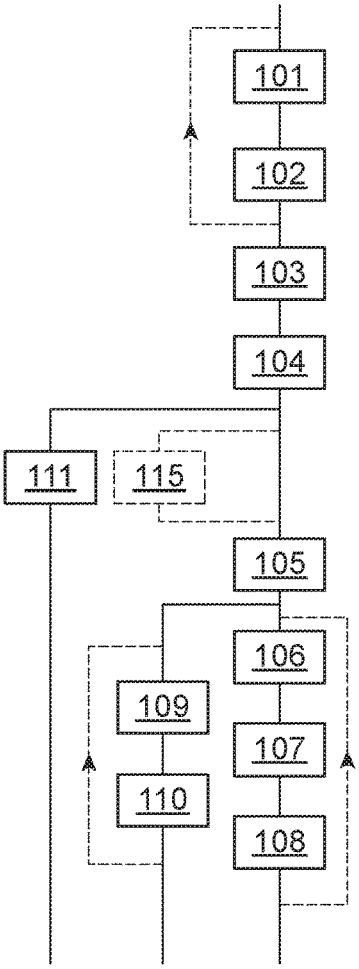
FIG. 2 is a diagram summarizing a method of assisting aiming at a target.

The ninth step 109 and the tenth step 110 preferably take place simultaneously with the sixth, seventh, and eighth steps as shown in the summary diagram of FIG. 2, and they are repeated until the projectile 10 strikes.

Also, during the eighth step 108, the points of contact 91 of the guide beam 9 in the environment may be captured during a second predetermined duration, and then displayed together with the selective image of the target 5.

Under such circumstances, during the display, eighth step 108, the selective image of the target 5 and of the current point of contact 91 of the guide beam 9 as picked up during the scanning, seventh step 107 can be displayed simultaneously together with at least one of the points of contact 91 that were previously displayed during the display, fifth step 105 and during any preceding display, eighth steps 108.

Likewise, the ninth step 109 may also take place over the second predetermined duration. As a result, the accuracy information 92 displayed during the tenth step 110 is determined over this second determined duration.

Figure 6:
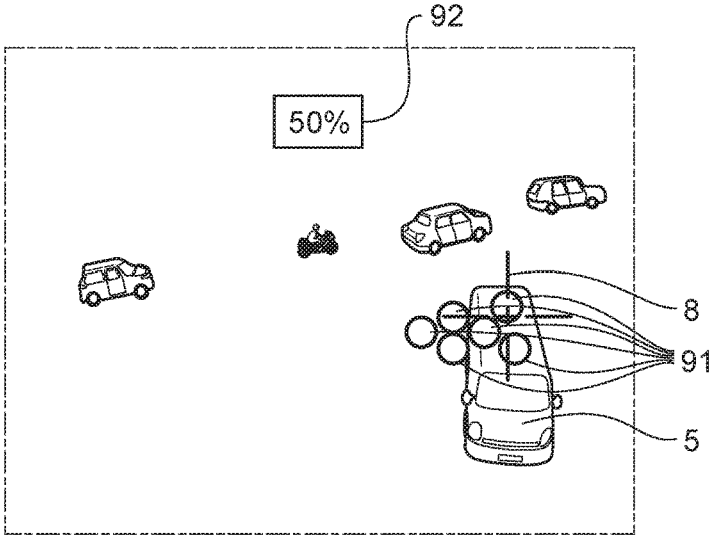
Figure 7:
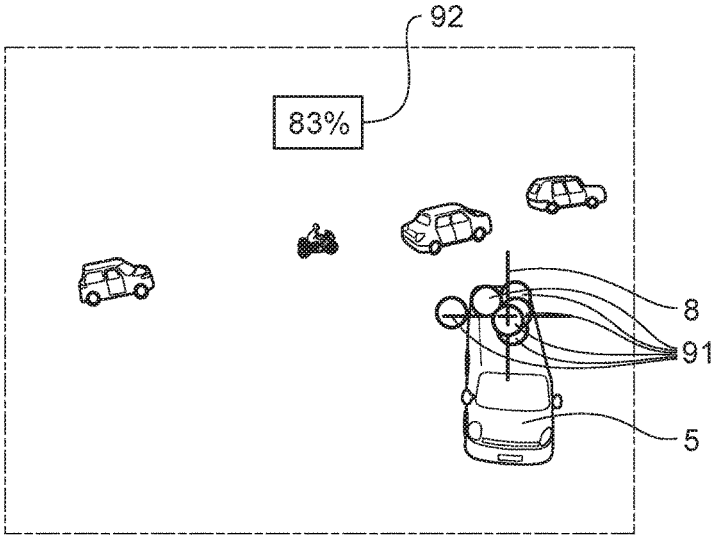

This information 92 is displayed on the display means 3 together with the points of contact 91 captured during the second predetermined duration, as shown in FIGS. 6 and 7. The operator can thus view the positions of the points of contact 91 over this second predetermined duration, and thus visualize the accuracy of the points of contact 91 relative to the target 5.

This information 92 can also be used by the system 24 guiding a projectile 10 in order to confirm, or else cancel, the locking of the projectile 10 on the target 5 and the launching of the projectile 10 towards the target 5. Specifically, if the aiming accuracy is judged by the operator to be too low, the operator can cancel launching of the projectile 10 or can pause it momentarily until sufficient aiming accuracy is achieved. Such cancellation may also be performed automatically if the accuracy information 92 about the points of contact 91 of the guide beam 9 touching the target 5 is below a predetermined threshold.

Finally, the aiming-assistance device 1 serves to identify the code of the guide beam 9 aiming at the target 5. Specifically, the computer 4 is configured to analyze the environment seen by the camera 2, and in particular the points of contact 91 of the guide beam 9 in the environment. During an eleventh step 111, the computer 4 can thus determine timing characteristics of the guide beam 9 and identify the code of the guide beam 9. This eleventh step 111 takes place after the fourth step 104 and in parallel with the following steps.

Naturally, the present invention may be subjected to numerous variations as to its implementation. Although several embodiments are described, it should readily be understood that it is not conceivable to identify exhaustively all possible embodiments. It is naturally possible to envisage replacing any of the means described by equivalent means without going beyond the ambit of the present invention.

What is claimed is:

1. A method of assisting aiming at a target, the method comprising:

a first step of completely scanning an environment with a camera;

a second step of displaying a complete image of the environment;

a third step of identifying and selecting a target in the complete image of the environment;

a fourth step of an operator pointing at the target with a guide beam;

a fifth step of displaying a complete image of the environment and of a first point of contact of the guide beam in the environment;

a sixth step of the operator once more pointing at the target with the guide beam;

a seventh step of selectively scanning the target and a second point of contact of the guide beam in the environment with the camera; and an eighth step of displaying a selective image of the target, of the first and second points of contact of the guide beam in the environment, and of any other point of contact of the guide beam in the environment previously displayed during any precedingly performed eighth step.

2. The method of assisting aiming at a target according to claim 1, wherein during the eighth step, the points of contact of the guide beam in the environment are captured over a predetermined duration, and then displayed together with the selective image of the target.

3. The method of assisting aiming at a target according to claim 1, wherein, after the eighth step of displaying a selective image, the method further comprises:

a ninth step of calculating a first number of the points of contact of the guide beam in the environment touching the target, and a second number of the points of contact of the guide beam in the environment not touching the target; and a tenth step of displaying information about an accuracy of the points of contact of the guide beam in the environment touching the target.

4. The method of assisting aiming at a target according to claim 3, wherein the information about the accuracy of the points of contact of the guide beam in the environment touching the target is formed by the first number and the second number, or else by a percentage of the points of contact of the guide beam in the environment touching the target from among all of the points of contact of the guide beam in the environment.

5. The method of assisting aiming at a target according to claim 3, wherein the ninth step takes place over a predetermined duration.

6. The method of assisting aiming at a target according to claim 1, wherein the guide beam is defined by a code constituted by a plurality of time characteristics, and the method further comprises, after the fourth step of pointing at the target and in parallel with the following steps, an eleventh step of analyzing and identifying the guide beam, the points of contact of the guide beam in the environment being analyzed to determine the plurality of time characteristics of the guide beam and thereby identify the code of the guide beam.

7. The method of assisting aiming at a target according to claim 6, wherein when the guide beam is constituted by a succession of pulses, the plurality of time characteristics of the guide beam are a frequency and a duration of the pulses.

8. The method of assisting aiming at a target according to claim 1, wherein the method further comprises, between the fourth step of pointing at the target and the fifth step of displaying a complete image, an intermediate step of completely scanning the environment with the camera to update the display of the target and of the environment.

9. The method of assisting aiming at a target according to claim 1, wherein crosshairs are displayed on the target during the fifth and eighth steps of displaying an image to facilitate identifying the target.

10. The method of assisting aiming at a target according to claim 1, wherein the seventh step of selectively scanning the target and the second point of contact of the guide beam in the environment is performed by capturing each item in the environment for which a radiometric change is detected, and also capturing the second point of contact of the guide beam in the environment.

11. The method of assisting aiming at a target according to claim 1, wherein during the seventh step of selectively scanning the target and the second point of contact of the guide beam in the environment is performed by capturing information about particular items in the environment that are moving, and also capturing the second point of contact of the guide beam in the environment.

12. The method of guiding a projectile by means of a guide beam, the method comprising:

a step of illuminating a target by a guide beam, a step of locking the projectile on the target, a step of launching the projectile; and a step of guiding the projectile towards the target;

wherein the method of assisting aiming according to claim 1, is applied during the step of illuminating a target in to improve the accuracy with which the target is illuminated.

13. The method of guiding a projectile by means of a guide beam according to claim 12, wherein the step of locking the projectile on the target and/or the step of launching the projectile is/are cancelled as a function of information about the accuracy of the points of contact of the guide beam in the environment touching the target and/or about a plurality of time characteristics of the guide beam.

14. A device for assisting aiming at a target comprising a camera, display means, a computer, and selector means, wherein the device performs the method according to claim 1 and the camera is a camera suitable for capturing specific information about particular items in the environment, the target being a particular item in the environment.

15. The device for assisting aiming at a target according to claim 14, wherein the computer is configured to analyze each selective image successively displayed on the display means and to determine a first number of points of contact of the guide beam in the environment touching the target, and a second number of points of contact of the guide beam in the environment not touching the target, and then to determine information about the accuracy of the points of contact of the guide beam in the environment touching the target.

16. The device for assisting aiming at a target according to claim 14, wherein the computer is configured to analyze the environment seen by the camera and the points of contact of the guide beam in the environment, to determine a plurality of time characteristics of the guide beam and to use the plurality of time characteristics to identify the guide beam.

17. A system for guiding a projectile by means of a guide beam, the system comprising a generator for generating a guide beam and a projectile provided with a receiver device, wherein the system for guiding a projectile includes a device for assisting aiming according to claim 14.

18. The system according to claim 17 for guiding a projectile by a guide beam, wherein the system for guiding a projectile by a guide beam performs the method of guiding a projectile by a guide beam according to claim 12.

19. The method of assisting aiming at a target according to claim 1, wherein at least one other point of contact of the guide beam in the environment was previously displayed during at least one precedingly performed eighth step, wherein the selective image is further of the at least one other point of contact of the guide beam in the environment.

20. The method of assisting aiming at a target according to claim 1, further comprising repeating the sixth, seventh, and eighth steps, wherein the selective image is further of the second point of contact of the guide beam in the environment from each repeated seventh step.

* * * * *